US005271185A

United States Patent [19]

Hosokawa

[11] Patent Number: 5,271,185

[45] Date of Patent: Dec. 21, 1993

[54] APPARATUS FOR CHAMFERING NOTCH OF WAFER

[75] Inventor: Kaoru Hosokawa, Saitama, Japan

[73] Assignee: Shin-Etsu Handotai Co., Ltd., Tokyo, Japan

[21] Appl. No.: 897,038

[22] Filed: Jun. 11, 1992

[30] Foreign Application Priority Data

Jun. 12, 1991 [JP] Japan ..... 3-167753

[51] Int. Cl.[5] ..... B24B 9/00

[52] U.S. Cl. ..... 51/101 R; 51/283 E

[58] Field of Search ..... 51/100 R, 101 R, 283 R, 51/283 E, 284 E, 101 LG, 106 R, 51 R

[56] References Cited

U.S. PATENT DOCUMENTS

| | | | |
|---|---|---|---|
| 2,767,520 | 10/1956 | Rudnicki | 51/101 R |
| 3,815,288 | 6/1974 | Wilson | 51/101 R |
| 3,864,878 | 2/1975 | Ledebur et al. | 51/101 R |
| 4,864,779 | 9/1989 | Ozaki | 51/283 E |
| 4,905,425 | 3/1990 | Sekigawa et al. | 51/283 E |
| 4,964,239 | 10/1990 | Gottschald et al. | 51/284 E |
| 5,009,038 | 4/1991 | Yoshikawa et al. | 51/101 R |
| 5,036,624 | 8/1991 | Steere, Jr. | 51/34 C |
| 5,097,630 | 3/1992 | Maeda et al. | 51/50 R |
| 5,185,965 | 2/1993 | Ozaki | 51/283 E |

FOREIGN PATENT DOCUMENTS

| | | | |
|---|---|---|---|
| 2453885 | 5/1975 | Fed. Rep. of Germany | 51/101 R |

*Primary Examiner*—D. S. Meislin
*Assistant Examiner*—Bryan Reichenbach
*Attorney, Agent, or Firm*—Townsend & Banta

[57] ABSTRACT

A notch of a semiconductor wafer is accurately and efficiently chamfered by the use of an apparatus which comprises a rotary disk grindstone, a wafer retaining mechanism for disposing the surface of a wafer so as to intersect the surface of the grindstone, a first drive mechanism capable of rotating the wafer within a prescribed range of angle around the central axis perpendicular to the main surface of the wafer thereby continuously positioning the surface of a notch of the wafer subjected to grinding relative to the grinding surface of the grindstone and effecting required grinding, a second drive mechanism capable of causing the grindstone and wafer to be relatively moved forward and backward in the radial direction of the grindstone, a third drive mechanism capable of causing the grindstone and wafer to be relatively moved forward and backward in the direction of thickness of the wafer, and a profiling mechanism capable of relatively guiding the notch and grindstone and consequently chamfering the notch in the circumferential direction and/or in the direction of thickness thereof. The profiling mechanism is provided with a reference plate corresponding in shape at least to the notch of the wafer and a disk corresponding in shape to the grindstone and permitting positional adjustment.

2 Claims, 2 Drawing Sheets

APPARATUS FOR CHAMFERING NOTCH OF WAFER

BACKGROUND OF THE INVENTION

1. Field of the Invention

This invention relates to an aparatus for chamfering a notch of a semiconductor wafer, which performs the chamfering work of the notch while keeping the wafer rotating round the central axis perpendicular to the main surface thereof. More particularly, this invention relates to a chamfering apparatus which is furnished with a profiling mechanism to be operated specifically in the chamfering work.

2. Description of the Prior Art

On account of effective application of photolithography, it has been customary for wafers such as semiconductor wafers to have an orientation flat (hereinafter referred to as "OF") formed thereon by grinding off to leave a short linear cut in part of the periphery of a wafer thereby facilitating correct positioning of the wafer on an exposure device.

The formation of the OF, however, inevitably results in removal of a large portion of the wafer. Particularly in the production of wafers of a large diameter, the cumulative amount of portions wasted by this removal is so large as to impair the yield of products conspicuously. The fact that this impaired yield prevents expensive semiconductor wafers from being efficiently utilized has posed a problem.

In the circumstances, the practice of imparting a notch substantially in the shape of the letter V or substantially in the shape of an arc to the periphery of a given wafer has come to prevail for the purpose of efficiently utilizing produced wafers. Particularly the V-shaped notches have been finding extensive utility by reason of their outstanding accuracy of positioning.

Since the wafers are destined to be conveyed a number of times on production lines as in the process for manufacture of devices, their peripheries are possibly subject to chippings on colliding with parts of equipment used in the manufacturing process and the produced semiconductor devices consequently suffer from degradation of characteristic properties. It has been customary, therefore, for the wafers to have their peripheral parts chamfered.

The wafers furnished with a notch as described above, however, have found on adaptability for any work of conventional chamfering technique because the notch is small in size as compared with the peripheral length of a wafer. As the semiconductor IC's have gained in number of components per chip, however, there come to entail the drawback that the notch of their wafers causes chippings when the wafers are positioned in the process of device production by aligning the notches to a pin of rigid material. Since sharp edges of the wafers are not easily removed by machining, the sharp edges conspicuously increase occurrence of dust and the effort to preclude chipping fails. This fact has posed a problem too serious to be ignored.

This invention, initiated in the light of this problem, has as an object the provision of an apparatus for chamfering a notch of a wafer, which apparatus is capable of easily and accurately chamfering a sharp edge such as of the notch and enabling the work of chamfering the notch to be carried out in high efficiency. Moreover, this apparatus enjoys simplicity of construction.

SUMMARY OF THE INVENTION

To accomplish the object described above, this invention contemplates an apparatus which is characterized by being provided with a rotary disk grindstone, a wafer retaining mechanism for disposing the surface of a wafer so as to intersect the surface of the grindstone, a first drive mechanism capable of rotating the wafer within a prescribed range of angle around the central axis perpendicular to the main surface of the wafer thereby continuously positioning the surface of a notch of the wafer subjected to grinding relative to the grinding surface of the grindstone and effecting required grinding, a second drive mechanism capable of causing the grindstone and wafer to be relatively moved forward and backward in the radial direction of the grindstone, a third drive mechanism capable of causing the grindstone and wafer to be relatively moved upward and downward in the direction of thickness of the wafer, and a profiling mechanism capable of relatively guiding the notch and grindstone and consequently chamfering the notch in the circumferential direction and/or in the direction of wall thickness thereof.

DETAILED DESCRIPTION OF THE PREFERRED EMBODIMENTS

In the apparatus of this invention for chamfering the notch of a wafer which is constructed as described above, the wafer is rotated within a prescribed range of angle as the first to third drive mechanisms are operated and the grindstone and wafer are consequently moved relatively in the direction approaching to or separation from each other through the medium of the profiling mechanism. As a result, the surface of the notch subjected to grinding can be continuously and accurately positioned relative to the grinding surface of the grindstone under the guiding action of the profiling mechanism and the chamfering work can be carried out accurately and efficiently on the notch in the circumferential direction and/or in the direction of wall thickness thereof.

The profiling mechanism can select the reference plate and guide surface of desired shape and in accordance with size the figure of the notch such as a V or a semi-circle as well as the shape of the chamfer of the notch to be chamfered. This reference plate and a disk identical in diameter with the grindstone can be produced by precision machining of hard metal. Though this invention is directed to a method and apparatus for chamfering the notch of a wafer which has already undergone the notching work and has the inner periphery of the notch left yet unchamfered, it may be embodied in machining a wafer which has undergone no notching work and producing a wafer furnished with a notch.

The apparatus of this invention for chamfering the notch of a wafer will be described below with reference to the accompanying drawings illustrating an embodiment of this invention.

Figure 1:
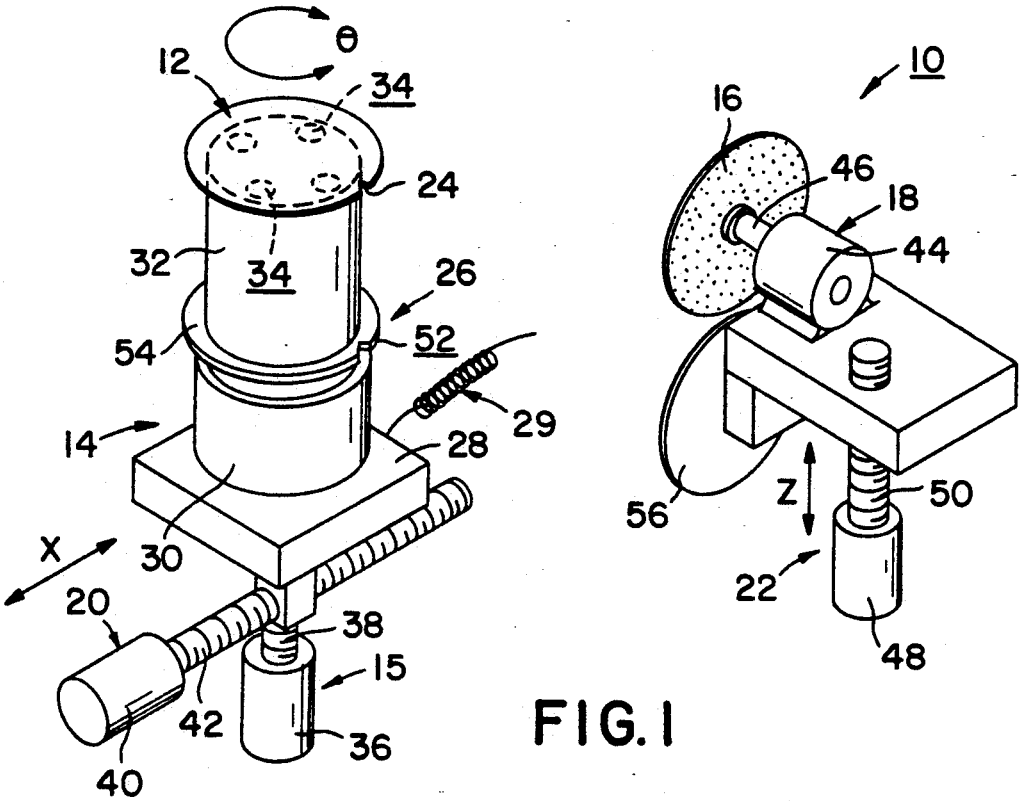
FIG. 1 is a perspective explanatory diagram of an apparatus for chamfering a notch of a wafer as an embodiment of this invention.
Figure 2:
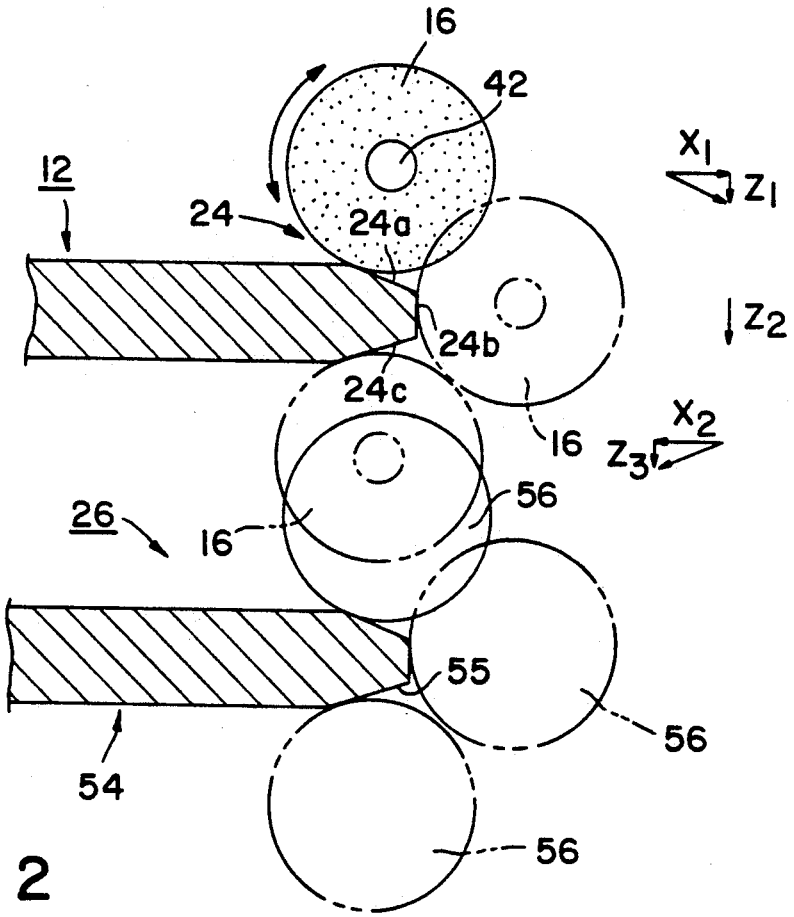
FIG. 2 is an explanatory diagram illustrating a chamfering work being performed in the direction of inside wall thickness of the notch.

In FIG. 1, the reference numeral 10 stands for an apparatus for chamfering the notch as an embodiment of this invention. This notch chamfering apparatus 10 is provided with a wafer retaining mechanism 14 for retaining a wafer 12 in a given posture, a first drive mechanism 15 for rotating this wafer 12 within a predetermined rang of angle around the central axis perpendicular to the main surface of the wafer (in the direction indicated by the arrow $\theta$), a rotary drive mechanism 18 which positions a grindstone 16 of the shape of a disk in such a manner that the surface thereof intersects the surface of the wafer 12 (perpendiculary intersects in this embodiment), a second drive mechanism 20 provided on the wafer retaining mechanism 14 for the purpose of moving the grindstone 16 and wafer 12 relatively forward and backward in the radial direction of the grindstone 16 (in the direction indicated by the arrow X), a third drive mechanism 22 provided on the rotary drive mechanism 18 for the purpose of moving the grindstone 16 and wafer 12 relatively forward and backward in the direction of thickness of the wafer 12 (in the direction indicated by the arrow Z), and a profiling mechanism 26 for relatively guiding a notch 24 of the wafer 12 and the grindstone 16 and performing a chamfering work on the notch in the circumferential direction and/or in the direction of thickness thereof. The profiling mechanism 26 comprises a reference plate 54 possessing a groove corresponding to the wafer notch subjected to chamfering work and a disk 56 adapted to be guided by having the peripheral edge thereof held in contact with a curved chamfering part guiding surface 55 of the reference plate 54 (FIG. 2).

The wafer retaining mechanism 14 is provided with a base stand 28. This base stand 28 is provided with a cylindrical part 30. A rotary base 32 is seated on this cylindrical part 30. On the upper end surface of this rotary stand 32, are formed a plurality of suction holes 34 communicating with a vacuum pump not shown in the diagram and serving to attract the wafer 12 by suction. The first drive mechanism 15 is provided with a pulse motor 36 in the form of a servomotor. A feed screw 38 is connected to the pulse motor 36 and this feed screw is joined coaxially to the rotary stand 32.

The second drive mechanism 20 is provided with a pulse motor 40. A feed screw 42 connected to the rotary shaft of this pulse motor is coupled with the wafer retaining mechanism 14. The rotary drive mechanism 18 is provided with an electric motor 44. To a rotary shaft 46 of this electric motor 44, the grindstone 16 is rotatably fixed. To this rotary drive mechanism 18 is joined a feed screw 50 which is connected to a pulse motor 48 serving as a component for the third drive mechanism 22.

The profiling mechanism 26 has the shape of a disk conforming to the wafer 12 and is provided with the reference plate 54 having a groove 52 formed therein so as to conform to the notch 24 and the disk 56 possessing a shape corresponding to the grindstone 16 and permitting adjustment of position. This reference plate 54 is provided with the guiding surface 55 curved along the direction of thickness of the wafer 12 (the direction indicated by the arrow Z) (FIG. 2). The reference plate 54 is set detachably to the rotary base 32 and the disk 56 is fixed detachably to the rotary drive mechanism 18 parallelly to the grindstone 16. The profiling mechanism 26 can be conformed to various shapes of the notch 24 by selecting the shapes of the reference plate 54 and disk 56. In the profiling mechanism 26, the base stand 28 of the wafer retaining mechanism 14 is urged in a fixed direction along a guide not shown in the diagram, specifically in the driving direction X of the second drive mechanism 20, for example, by virtue of a spring 29 or weight (not shown in the figures) so that the disk 56 and the reference plate 54 may maintain mutual contact at a part thereof in a desired direction of thickness and at a desired angle of rotation of the reference plate 54.

Now, the operation of the notch chamfering apparatus 10 constructed as described above will be described.

First, the wafer 12 of the shape of a disk is set in place on the rotary stand 32 as one component of the wafer retaining mechanism 14 and is attracted to the rotary stand 32 through the medium of the suction holes 34 by virtue of the suction effected with a vacuum pump not shown in the diagram. Here, the angular position of the wafer 12 or the angular position of the reference plate 54 is adjusted by virtue of positioning means not shown in the, diagram so that the notch 24 of this wafer 12 is aligned to the groove 52 of the reference plate 54. After the notch 24 of the wafer 12 and the grindstone 16 have been disposed at prescribed positions allowing perpendicular intersection of their respective surfaces, the first drive mechanism 15 to the third drive mechanism 22 are selectively or synchronously driven and controlled.

At this time, the second drive mechanism 20 is utilized for adjusting the relative positions of the wafer 12 and the grindstone 16 in the X direction. In the notch chamfering work performed in this invention with the profiling mechanism, the spring or weight not shown in the diagram and the guide mechanism not shown in the diagram cooperate to move the base stand 28 in the direction indicated by the arrow X with part of the peripheral edge of the disk 56 pressed in the direction indicated by the arrow X, constantly against a curved chamfer of the groove guiding surface 55 of the reference plate 54. The first drive mechanism 15 rotates the rotary stand 32 at a given rotational speed in the direction indicated by the arrow $\theta$ through the medium of the feed screw 38 under the action of the pulse motor 36. In the meantime, the grindstone 16 is rotated through the medium of the rotary shaft 46 under the driving action of the electric motor 44. As a result, the wafer 12 and the grindstone 16 in rotation are relatively moved toward or away from each other and the wafer 12 is rotated in the direction indicated by the arrow $\theta$ and the chamfering work is performed in the circumferential direction of an angular part **24*a* of the notch 24** (FIG. 2).

The grindstone 16, while performing the chamfering work in the direction of length of the inner periphery of the angular part **24*a* of the notch 24, is moved as shown in FIG. 2 at a relatively low speed in the direction of the arrow along the angular part 24*a*. To be specific, when a signal to drive is input into the pulse motor 48 as a component of the third drive mechanism 22, the feed screw 50 is rotated in a direction through the medium of this pulse motor 48 and the rotary drive mechanism 18 joined to this feed screw 50 is slowly moved in the direction of the arrow $Z_1$. At the same time, the profiling mechanism 26 adjusts the positional relation between the reference plate 54 and the disk 56 while keeping the circumferential edge of the disk 56 in constant contact with the curved guiding surface 55 of the reference plate 54, with the result that the grindstone 16 and the wafer 12 are relatively moved in the direction of the arrow $X_1$ and the grindstone 16 is positioned relative to the angular part 24a. After the chamfering work covering a limited minimal width in the direction of length of the inner periphery of the angular part 24a has been completed as described above, therefore, the chamfering work is continuously repeated with next minimal width in the direction of length of the inner periphery of the angular part 24a**.

Since the grindstone 16 performs the chamfering work on the angular part 24a continuously across successive widths of a given minimal size as described above, the possibility of this angular part 24a being machined so as to give rise to a slightly depressed surface conforming to the shape of the grindstone 16 in case of a stepwise movement of the grindstone 16 is nil. The angular part 24a is ideally ground in the shape of a flat surface or in the shape of even a curved surface containing slightly outward R's in the cross section taken in the direction of wafer thickness. The question a to whether the chamfer is obtained in the shape of a flat surface or in the shape of a curved surface containing outward R's in the cross section taken in the direction of thickness of the wafer is freely decided by selecting the design shape of the profiling mechanism.

Subsequently, the outermost peripheral surface part 24b and the angular part 24c of the wafer 12 are continuously ground similarly in a plurality of working rounds, one for each of the successive widths of the predetermined size mentioned above. Here, the grindstone 16 is moved in the direction of the arrow $Z_2$ while the machining is in process on the outer peripheral part 24b which is perpendicular to the main surface of the wafer 12. While the machining is in process on the angular part 24c, the grindstone 16 and the wafer 12 are relatively moved in the directions of the arrows $X_2$ and $Z_3$. As a result, the chamfering work of the wafer 12 in the circumferential direction and in the direction of wafer thickness is continuously and efficiently carried out.

In this embodiment, the reference plate 54 and the disk 56 which are components of the profiling mechanism 26 are disposed on the rotary stand 32 for retaining the wafer 12 and the rotary drive mechanism 18. Under the guiding actions of the reference plate 54 and the disk 56, therefore, the wafer 12 and the grindstone 16 can be accurately and easily positioned. The arrangement has an effect of enabling the chamfering work of this wafer 12 to be carried through efficiently.

Particularly noteworthy is the fact that the wafer 12 and the grindstone 16 are so disposed that the respective surfaces thereof perpendicularly intersect and the reference plate 54 as a component of the profiling mechanism 26 has therein a groove 52 conforming to the shape of the notch 24. It has an advantage in that the surface of the notch 24 which is appreciably small as compared with the size of the wafer 12 can be continuously and accurately positioned for the sake of chamfering relative to the grinding surface of the grindstone 16 by simply fitting the disk 56 to the groove 52 of the reference plate 54 and, consequently, the notch 24 can be chamfered with high accuracy by a conspicuously simplified operation.

Figure 3:
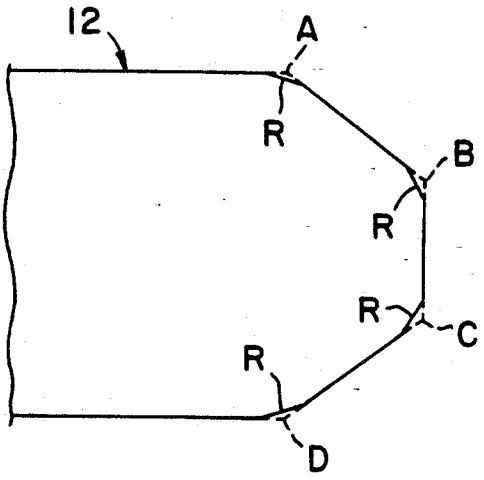
FIG. 3 is an explanatory diagram illustrating the notch which has undergone the chamfering work.

After the notch 24 has been chamfered, angular parts A to D (indicated by a broken line in FIG. 3) are formed and these angular parts A to D are liable to sustain chippings. In this embodiment, the reference plate 54 possesses the guide surface 55 which is curved along the direction of thickness of the wafer 12. Owing to the provision of this guide surface 55, the angular parts A to D can be very easily furnished with an R (indicated by a solid line in the diagram) without requiring any complicate control.

This embodiment has been portrayed as representing a case in which the chamfering work of the whole notch 24 is effected by moving the grindstone 16 in the direction of a wall thickness of the wafer 12 (the direction indicated by the arrow Z) while performing the chamfering work in the direction of length of the inner periphery of the notch 24. The chamfering work may be optionally carried out conversely by moving the grindstone 16 and the wafer 12 in the direction of length of the inner periphery of the wafer 12 while continuing the chamfering work in the direction of wall thickness of the notch 24.

To be specific, the wafer 12 is moved in the direction of the arrow X and the grindstone 16 is moved in the direction of the arrow Z to perform the chamfering work on a whole profile of the direction of thickness of the notch 24 by driving and controlling the profiling mechanism 26 and the third drive mechanism 22 and, at the same time, the wafer 12 is slowly rotated round the central axis thereof (in the direction of the arrow $\theta$) by rotating and driving the pulse motor 36 at an appreciably low speed. As a result, the grindstone 16 is enabled to continuously chamfer the notch 24 in the circumferential direction thereof while chamfering the notch 24 in the direction of the wafer thickness.

Figure 4:
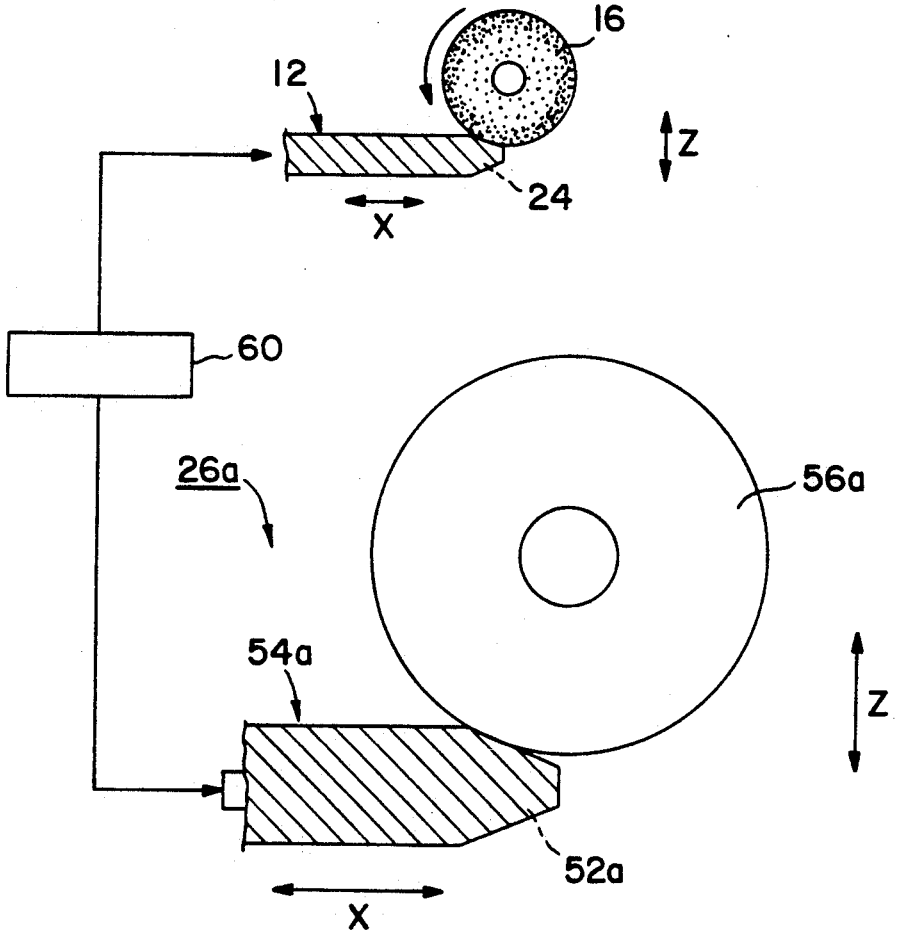
FIG. 4 is an explanatory diagram illustrating another profiling mechanism.

FIG. 4 illustrates a profiling mechanism 26a of another operating principle. This profiling mechanism 26a is provided with a reference plate 54 measuring a prescribed multiple of the size of the wafer 12 and a disk 56a measuring a prescribed multiple of the size of the grindstone 16. The status of motion of the reference plate 54a and disk 56a is introduced via a detector not shown in the diagram into an action reducing device 60 to be stored therein. The first drive mechanism 15 to the third drive mechanism 22 are driven and controlled on the basis of the information so stored.

By the use of the reference plate 54 of a size which is the prescribed multiple of the size of the wafer 12, a groove 52 corresponding to the notch 24 of an appreciably small size can be magnified and formed on the reference plate 54 and the groove 52 can be imparted with high accuracy. This fact has an advantage in that the wafer 12 and the grindstone 16 can be guided with added accuracy and the notch 24 of this wafer 12 can be chamfered with high accuracy through the medium of the profiling mechanism 26a which is furnished with the magnified reference plate 54 and the disk 56.

The apparatus of this invention for chamfering the notch of the wafer brings about the following effect.

The surface of the notch subjected to machining can be continuously and accurately positioned relative to the grinding surface of the grindstone because the first to third drive mechanisms are operated to move the grindstone and wafer relatively toward or away from each other under the guiding action of the profiling mechanism and, at the same time, rotate the wafer within a prescribed range of angle around the central axis thereof. As a result, the simple construction relying on the incorporation of the profiling mechanism enables the chamfering work to be performed accurately and efficiently on the notch of an appreciably small size in the circumferential direction and/or in the direction of thickness thereof. Further, the curved guide surface formed on the reference plate which is one component of the profiling mechanism allows the notch to be chamfered in the direction of thickness thereof and, at the same time, enables the angular parts formed by the chamfering work to be smoothly machined and prevents them from chipping.

What is claimed is:

1. An apparatus for chamfering a notch of a wafer by means of a profiling and grinding mechanism comprising:

a wafer retaining mechanism having a cylindrical part having a rotational axis and an upper end which is rotated within a predetermined range of angle by means of a first drive mechanism, and coaxially provided with a reference plate having a chamfering guide surface at its peripheral edge which is located at a certain distance from the upper end of the cylindrical part, the wafer to be treated being fixed by vacuum attraction to an upper end of a rotary stand having a rotational axis, said rotary stand being coaxially connected to said cylindrical part for rotation therewith;

a chamfering device comprising a motor, a disc-shaped grindstone rotated by means of the motor and a disc having a same diameter and a same thickness as the grindstone, the grindstone and the disc being arranged in a same plane in order that a line connecting center points of same side surfaces of the grindstone and the disc is parallel to the rotational axis of the rotary stand and that the distance between center points of the grindstone and the disc is equal to the distance between the upper end of the cylindrical part and the upper end of the rotary stand;

a second drive mechanism for moving the wafer retaining mechanism in a radial direction of the cylindrical part;

a third drive mechanism for moving said disc and said grindstone upon down in a direction parallel to the rotational axis of the cylindrical part in order that the wafer retaining mechanism and the grindstone move toward and away from each other; and a signal for controlling the third mechanism in order to relatively move the disc in contact with the chamfering guide surface so that, at the same time, the grindstone comes in contact with the notch of the wafer in order to chamfer the notch in accordance with the motion of the disc relative to the chamfering guide surface, and to duplicate the geometry of the chamfering guide surface on the notch.

2. An apparatus according to claim 1, wherein the chamfering guide surface is curved along the thickness direction of the reference plate.

* * * * *